United States Patent [19]

Huber

[11] Patent Number: 4,664,388

[45] Date of Patent: May 12, 1987

[54] GOLF CLUB SWING TRAINING DEVICE

[75] Inventor: Joe B. Huber, Phoenix, Ariz.

[73] Assignee: Correct Swing Corp. of America, Phoenix, Ariz.

[21] Appl. No.: 831,621

[22] Filed: Feb. 21, 1986

[51] Int. Cl.[4] ..... A63B 69/36

[52] U.S. Cl. ..... 273/186 A; 273/DIG. 20; 273/58 C; 273/194 B

[58] Field of Search ..... 273/193 R, 193 A, 194 R, 273/186 A, 186 R, 186 C, 186 B, 186 E, 194 B, DIG. 20, 58 C

[56] References Cited

U.S. PATENT DOCUMENTS

| | | | |
|---|---|---|---|
| 1,930,342 | 10/1933 | Graham | 273/193 A |
| 3,229,980 | 1/1966 | Silberman | 273/193 R X |
| 3,428,325 | 2/1969 | Atkinson | 273/193 R X |
| 3,466,049 | 9/1969 | Fox et al. | 273/193 R X |
| 4,598,911 | 7/1986 | Lepera | 273/186 A |

FOREIGN PATENT DOCUMENTS

| | | | |
|---|---|---|---|
| 472237 | 9/1937 | United Kingdom | 273/194 |
| 2148130 | 5/1985 | United Kingdom | 273/191 B |

*Primary Examiner*—George J. Marlo

*Attorney, Agent, or Firm*—Warren F. B. Lindsley

[57] ABSTRACT

A practice device comprising a ball suspended by a cord from a handle or from the shaft of a golf club for use in a set of drill steps intended to teach a proper golf swing. The control of the suspended ball necessitates concentration upon the utilization of centrifugal forces which are essential to a proper golf club swing.

3 Claims, 8 Drawing Figures

GOLF CLUB SWING TRAINING DEVICE

BACKGROUND OF THE INVENTION

Mastery of the game of golf is dependent upon achieving a proper golf club swing that correctly involves the simultaneous movement of the entire body of the golfer. Without a proper swing, it is impossible to drive the golf ball with consistent accuracy and with the desired force, both of which are essential to the realization of a satisfying game.

The entire golf club swing is important, including the backswing, the downswing and the follow-through. In addition to the mechanics of the swing, i.e., the grip and the position and motion of the arms and body, it is also important to achieve a proper tempo and rhythm.

More specifically, one of the most important characteristics of a good golf club swing is the utilization of centrifugal force whereby the arms of the golfer and his or her club tend to revolve or pivot as a unit about the golfer's head and neck while the head and neck remain substantially stationary. In this pivotal motion, the head of the golf club is treated as a weight suspended on a cord, with the cord simulating the shaft of the club and the arms of the golfer.

Instructional materials are readily available to players wishing to improve their skills, but it is one thing to be informed, and yet another to put the recommended techniques into practice. A practicing golfer, concentrating on his swing, may be sure in his own mind that he is implementing the proper form, while in reality, the routine he is practicing departs radically from its intended and imagined form.

What is needed is a practice instrument that provides visual and tactile feedback to the person employing it as a means for improving his or her swing.

SUMMARY OF THE INVENTION

In accordance with the invention claimed, a new and improved practice device or training aid is provided for use by a golfer in exercises intended for the development of a proper stance and swing.

It is, therefore, an object of the present invention to provide a new and improved method and practice device for use by golfers.

Another object of this invention is to provide such a device in a form that specifically encourages the utilization and incorporation of centrifugal forces that are essential to a proper golf club swing.

A further object of this invention is to provide such a practice device in a form that provides both visual and tactile feedback so that the user immediately is aware of any serious departure from a desired form.

A still further object of this invention is to provide such a practice device in a single and inexpensive form that is readily affordable by the average golfer.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
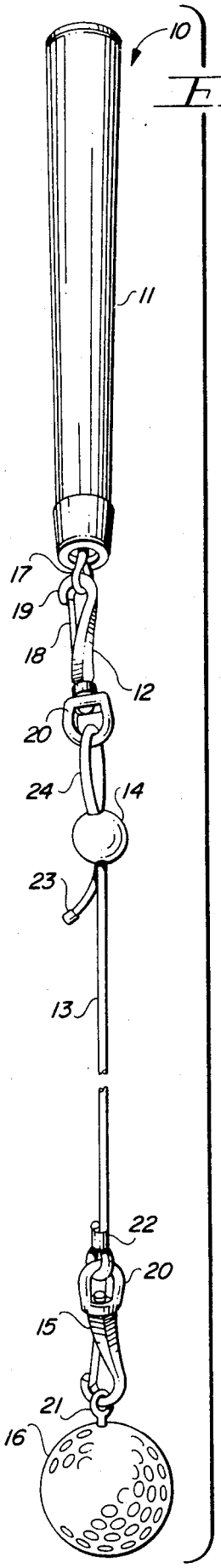
FIG. 1 is a perspective view of a golf swing practicing device embodying the invention.

Referring more particularly to the drawings by characters of reference, FIG. 1 discloses a practice device 10 embodying the invention comprising a short handle 11, a first swivel hook 12, a lanyard or cord 13 with an adjustable fastener 14, a second swivel hook 15 and a practice ball 16.

Handle 11, which is made of wood, rubber, plastic or other suitable material, is long enough to be gripped by both hands of a golfer in the conventional manner for gripping a golf club. It is tapered slightly to simulate a grip portion of a conventional golf club. An eye hook 17 extends from the lower end of handle 11 for engagement by swivel hook 12.

Swivel hook 12 is a conventional assembly of commonly used parts employing a snap or spring retainer 18 that prevents a hook 19 from unintentionally uncoupling. A ring 20 is pivotally connected to the hook portion in a well known manner.

Cord 13 is preferably formed of a nylon or other sturdy cord material, with fastener 14 forming a convenient means for securing one end of cord 13 to ring 20 in an easy and convenient adjustment manner so as to easily lengthen or shorten the cord. This type of fastener is available from Progress Co. of Altadena, Calif. under the model number "B-LOC-4". Swivel hook 15 may be identical to swivel hook 12.

Practice ball 16 resembles an ordinary golf ball in size and form. For certain recommended practice routines utilizing device 10, ball 16 may be a lightweight hollow plastic shell, and for other recommended routines, the shell may enclose a heavy metal weight such as weight 16C in FIG. 2. In the version of ball 16 shown in FIG. 1, an eye hook 21 extends from the surface of the ball for attachment to cord 13.

In the assembly of device 10, as shown in FIG. 1, the lower end of cord 13 loops through ring 20 of swivel hook 15 and folds back upon itself to be secured by a metal band 22. The upper end of cord 13 passes upward through fastener 14, loops through ring 20 of swivel hook 12 and down through fastener 14. Either of the two segments of cord 13 passing through fastener 14 may be moved upward or downward independently of the other in the process of adjusting the length of the cord, but the gripping action of fastener 14 is sufficient to prevent the free end 23 of cord 13 from being withdrawn from fastener 14 under forces normally applied at loop 24. Hook 12 snaps into eye hook 17 at the end of handle 11 and hook 15 snaps into eye hook 21 of ball 16 to complete the assembly of device 10.

Figure 2:
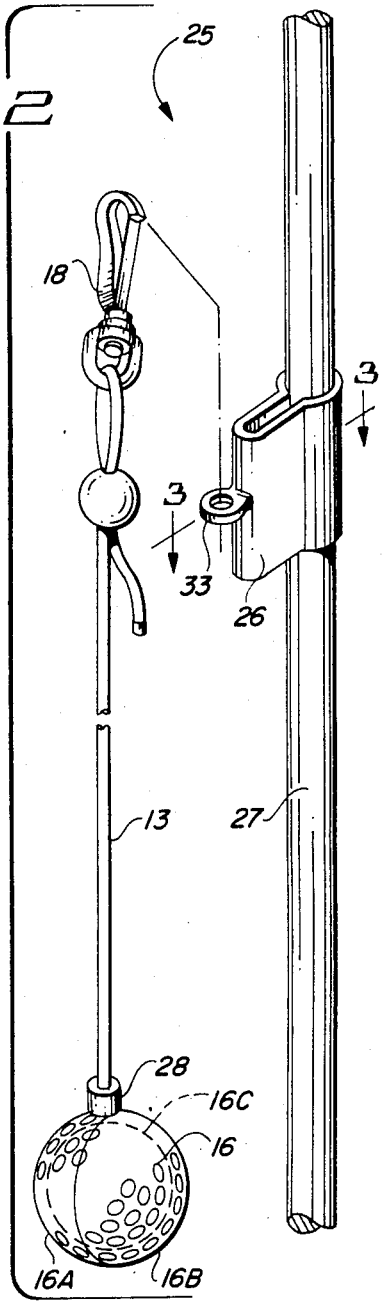
FIG. 2 is a perspective view of a modification of the practice device shown in FIG. 1.

The practice device 25 of FIG. 2 is substantially identical with device 10, except that handle 11 of device 10 is omitted, and in its place a clamp 26 is provided for attachment to shaft 27 of a conventional golf club.

In a further optional variation, the lower end of cord 13 of device 25 is secured directly to a simulated golf ball 16 rather than by means of the swivel hook 15 employed in device 10 of FIG. 1. In one embodiment, ball 16 is molded into two separable but interlocking hollow parts 16A and 16B, each of which is a hemispherical shell with a protruding hollow neck 28 formed at the junction of the interlocking shells. The lower end of cord 13 is knotted and passes through neck 28 and to the hollow interior of ball 16 before parts 16A and 16B forming ball 16 are fastened together by cementing or fusing together the parts, so that the knot in the end of cord 13 is retained inside of the ball. This modification may be further modified by attaching the knotted end of cord 13 to a weight 16C positioned inside of the interlocking parts 16A and 16B.

Figure 3:
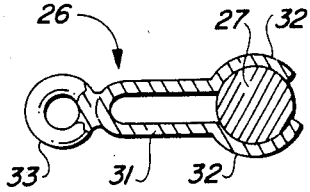
FIG. 3 is a cross-sectional view of FIG. 2 taken along the line 3—3.

Clamp 26, as shown in FIGS. 2 and 3, is a spring clip which may be formed from a flat sheet of spring steel or other metal, or molded from a suitable plastic material. Its U-shaped cross section resembles that of a hairpin with a shoulder portion 31 serving as a spring for the outer gripper portions 32. As noted, the gripper portions 32 comprise two legs of a "U"-shaped configuration which are shaped to conform with the surface of shaft 27. An eye hook 33 is provided at the closed end of the "U"-shaped configuration for attachment of spring clip 18 and its associated cord 13. Clamp 26 is installed over shaft 27 by spreading the legs of the "U"-shaped configuration and pressing the shaft between gripper portions 32. The spring force of the clamp holds it securely in place.

Figure 4:
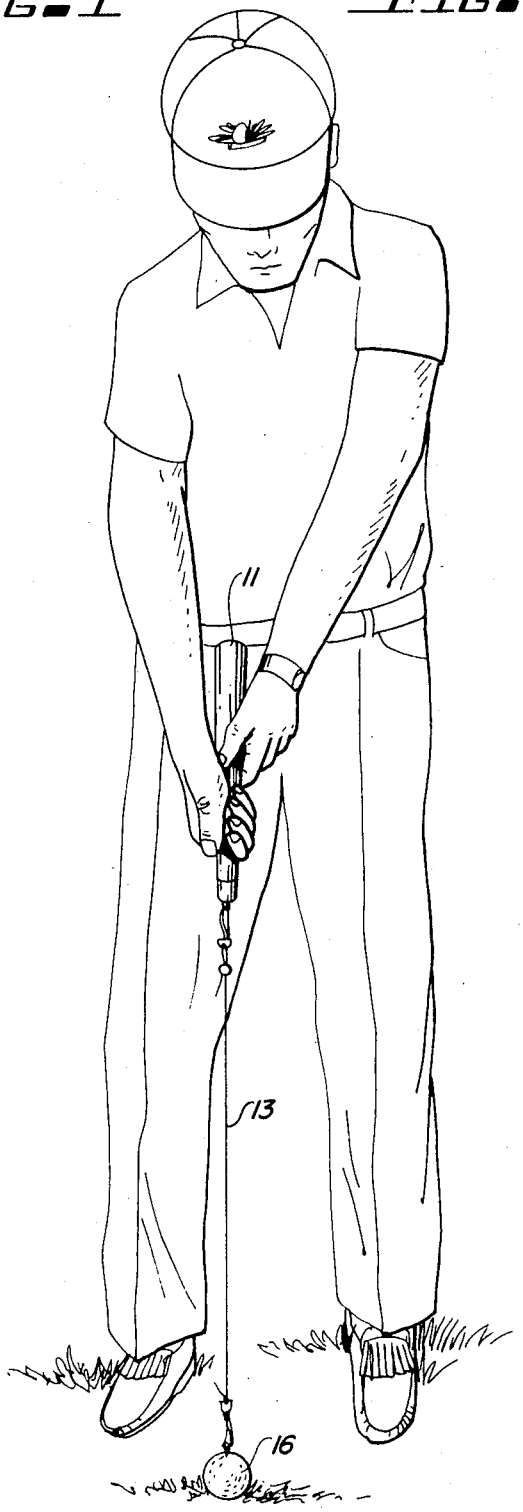
FIGS. 4–8 show successive positions of a golfer using the device of FIGS. 1 and 2 during a series of exercises simulating the golfer's swing with the starting position shown in FIG. 4, the backstroke underway in FIG. 5 and ending in FIG. 6, the downstroke having been already completed in FIG. 7 with the follow-through underway, and the follow-through ending in FIG. 8.

Devices 10 and 25 are intended to be employed in the execution of certain drill steps or exercises for improving the golfer's swing, the first of which is as follows:

Using device 10 with a weighted ball, the length of cord 13 is adjusted so that when the golfer assumes the starting position shown in FIG. 4 with his or her hands gripping handle 11 in the manner recommended for holding a golf club, and with his or her arms fully extended, ball 16 is suspended eight to ten inches above the ground.

From the starting position shown in FIG. 4, the golfer begins swinging the weighted simulated golf ball back and forth continuously, trying to keep the path of the ball within a fixed path or groove, while limiting the swing to waist height. In executing this drill step, the golfer concentrates on keeping the motion of his or her arms aligned and synchronized with the motion of the ball so that the arms, cord 13 and ball 16 move back and forth as a unit to the maximum possible degree. A steady centrifugal force will be felt by the golfer when he or she is properly executing this drill step.

This first drill step is intended to help the golfer learn the correct feel of the centrifugal force, as well as the correct rhythm and timing for such action. In addition, the various members of the golfer's body are being trained to maintain its necessary coordination with the swing of the arms and golf club. Mastery of this drill step is an important prerequisite for moving on to the second drill step.

The second drill step proceeds as follows:

For this drill step, device 10 is again utilizing the weighted ball 16.

Clamp 26 shown in FIG. 2 is attached to shaft 27 of a #7 iron 27' or other suitable golf club at a point on the shaft just below the handle or grip of the golf club.

The length of cord 13 is then adjusted so that when the #7 iron is held two to three inches above the ground surface, ball 16 is again eight to ten inches above the ground.

The golfer now assumes the same starting position as shown in FIG. 4 for the first exercise.

Figure 5:
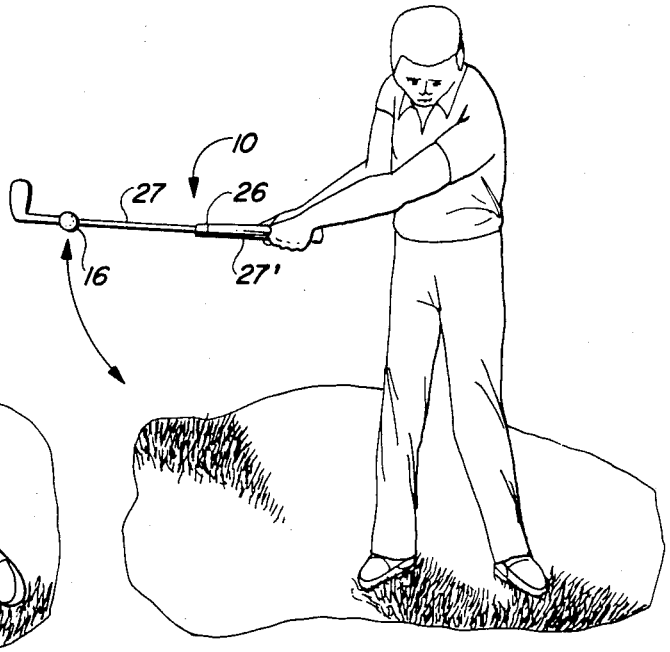

From the starting position, the back and forth motion is again initiated in the manner shown in FIG. 5. For reasons of safety, the swing is again limited to waist height. In this exercise, the golfer again concentrates on maintaining a constant path or groove while also striving for alignment of the arms, the club and the suspended ball. Success is realized when suspended ball 16 and cord 13 remain in alignment with shaft of the #7 iron during a swinging action.

This second drill step is intended to aid the golfer in learning the correct path, arc and plane in which the club must swing to produce a straight shot. If, during the course of the drill the ball 16 and cord 13 wrap around the club, the practicing golfer might be twisting, jerking, pushing or pulling the club, or moving it in an improper path. To achieve a proper result, one must concentrate on swinging the weighted ball while allowing the club to follow the action. Practice of the second drill step continues until a steady, smooth and rhythmic half swing is achieved.

Following the satisfactory completion of the second drill step, the golfer proceeds to the third drill step which is conducted with a #7 iron without the use of either device 10 or device 25.

In the third drill step, the golfer moves to a practice area to practice the waist high swing and using conventional golf balls. During this exercise, the golfer concentrates on swinging the golf club in the exact same manner that was learned in the first two drill steps. With a #7 iron, the balls, when hit, should travel 30 to 40 yards.

Figure 6:
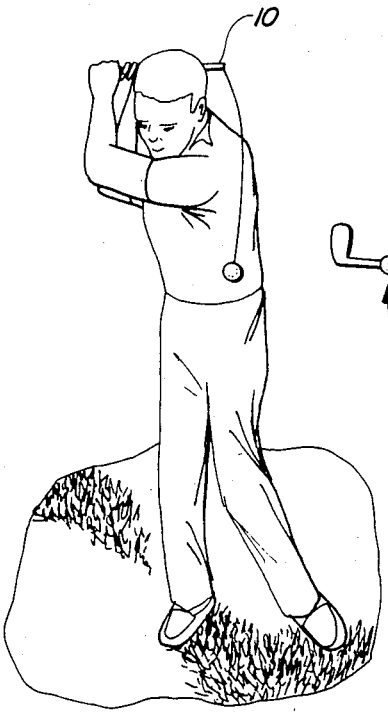

From the third drill step, the golfer moves on to the fourth drill step which is intended to teach the proper technique for a full golf club swing. The fourth drill step proceeds as follows:

Using device 10 with a hollow unweighted ball 16, the golfer assumes the starting position shown in FIG. 4 and begins his or her backswing as shown in FIG. 6. As shown in FIG. 6, the arms and shoulders move in unison with the extended device 10 pivoting about the golfer's stationary head and shoulders. As the backswing is completed, as shown in FIG. 6, the left shoulder moves under the chin.

Figure 7:
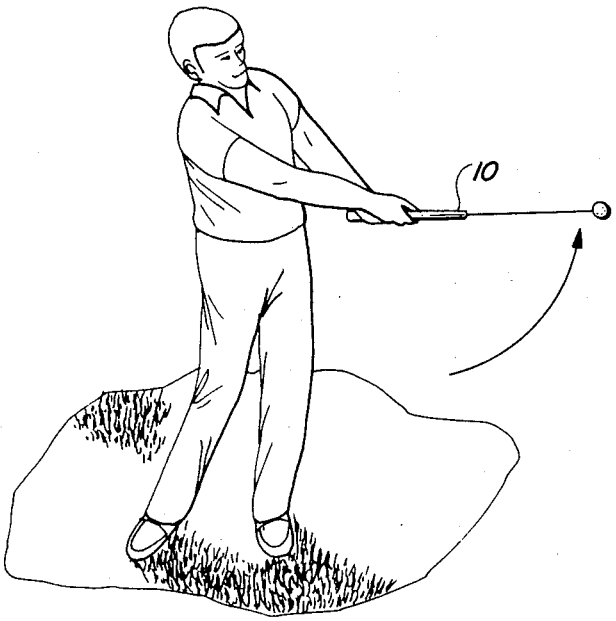
Figure 8:
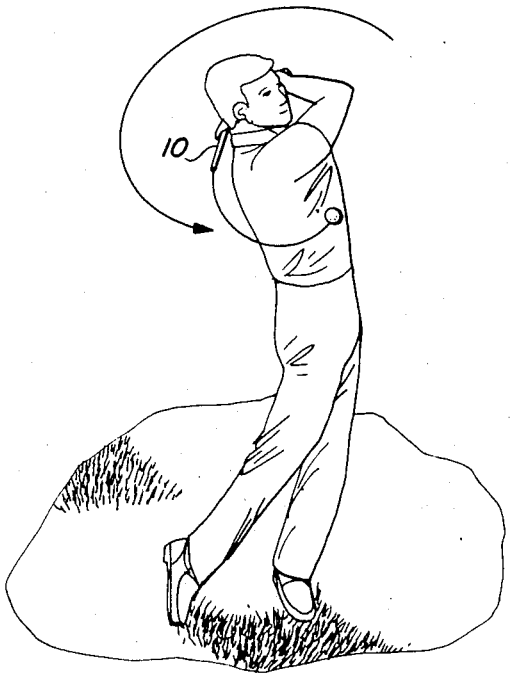

From the completed backswing stroke of FIG. 6, the downswing and follow-through strokes of FIGS. 7 and 8 are executed with the hips, shoulders and whirling arms employed to create the centrifugal force that was learned and experienced in the first three drill steps. Upon the completion of the forward swing and follow-through, the right shoulder moves under the chin; the head and neck again remaining as nearly stationary as possible without tension or rigidity throughout the course of the swing.

With a correct swing, the light unweighted ball 16 should strike the golfer just below his left shoulder at the end of the backswing and below the right shoulder at the end of the forward swing.

In this drill step, the golfer is training the various muscles of his or her body for the proper execution of the full golf swing. These drill steps encourage a pendulum action pivoting about the fixed position of the head and shoulders with the ball following an arc or circle of a constant radius. One of the two arms of the golfer is extended at all times to maintain the constant radius desired.

Thus, devices 10 and 25 are shown to be useful in the execution of drill steps and exercises which encourage and assist the practicing golfer to employ the techniques which result in a proper and effective swing in accordance with the stated objects of the invention.

Although but a few embodiments of the invention have been illustrated and described, it will be apparent to those skilled in the art that various changes and modifications may be made therein without departing from the spirit of the invention or from the scope of the appended claims.

What is claimed is:

1. A device adapted to be removably attached to the shaft of a golf club for use in developing correct swing movements of a golf club comprising:

a simulating golf ball means, a cord of a predetermined length for attaching at one end to said golf ball means, and means attached to the other end of said cord for fastening said cord to a golf club, said means comprises a first clamp for gripping the shaft of a golf club at a point between its ends and a second swivel clamp connected to the other end of said cord for detachably connecting said cord to said first clamp, said golf ball means comprising a spherically shaped weight secured to said cord and a pair of hollow interlocking plastic hemispherical parts mounted around said weight.

2. The device set forth in claim 1 in further combination with:

a golf club having a handle.

3. The device set forth in claim 2 wherein:

said first clamp grips a shaft of said golf club immediately below its handle.

* * * * *